US005669577A

United States Patent [19]

Nagashima

[11] Patent Number: 5,669,577

[45] Date of Patent: Sep. 23, 1997

[54] WINDING DEVICE

[75] Inventor: Masamitsu Nagashima, Kuroiso, Japan

[73] Assignee: Bridgestone Metalpha Corporation, Tokyo, Japan

[21] Appl. No.: 509,832

[22] Filed: Aug. 1, 1995

[30] Foreign Application Priority Data

Aug. 2, 1994 [JP] Japan ..... 6-181643

[51] Int. Cl.[6] ..... B65H 75/24

[52] U.S. Cl. ..... 242/573.9

[58] Field of Search ..... 242/572, 573, 242/573.9

[56] References Cited

U.S. PATENT DOCUMENTS 1,956,906 5/1934 Mikaelson .

4,728,051 3/1988 Rothenpieler et al. ..... 242/573.9

*Primary Examiner*—John P. Darling

*Attorney, Agent, or Firm*—Knobbe, Martens, Olson & Bear, LLP

[57] ABSTRACT

An air cylinder is actuated to remove a winding reel from a winding shaft. When a piston rod is driven to advance in an axial direction of the winding shaft toward a transmission rod and abuts and presses against a pressure-applied end portion of the transmission rod against a first coil spring, the piston rod receives reactive force from the pressure-applied end portion. On receiving reactive force, the air cylinder moves back in an axial direction of the winding shaft, which is opposite to that in which the piston rod advances, on a linear guide against a second coil spring and a pawl piece abuts against and engages with a flange. After the pawl piece and the flange have engaged with each other, the air cylinder is prevented from moving back in the axial direction still further. Pressing force of the piston rod onto the pressure-applied end portion of the transmission rod when a diameter of a collet sleeve is reduced acts on the pawl piece via the flange and then does not act on a bearing as thrust load.

10 Claims, 6 Drawing Sheets

WINDING DEVICE

BACKGROUND OF THE INVENTION

1. Field of the Invention

The present invention relates to a winding device for winding filaments, and particularly to a winding device in which a winding reel can be mounted on and removed from a winding shaft by expansion and contraction of the diameter of a collet sleeve.

2. Description of the Related Art

A stranded wire such as a steel cord is manufactured through each production process of a wire-drawing process of metallic wire rods and a stranding process thereof. Namely, metallic wire rods which have been subjected to a wire-drawing process are wound around a winding reel and are passed to a subsequent stranding process. The wire rods which have been subjected to the stranding process are similarly wound around a winding reel and then are served as products.

This winding processing is effected by using a winding device. First, an empty winding reel is mounted on a winding shaft. When the winding process of a predetermined amount of wire is completed, the winding reel is removed from the winding shaft and a next empty winding reel is mounted on the winding shaft. This operation is repeatedly performed.

A method of mounting the winding reel on the winding shaft is broadly classified into two types: one is a screwed type and the other is a clamp type using a collet sleeve and a taper shaft. The clamp type is further classified into a screw-in system and a system in which spring force is used.

The clamp system in which spring force is used is described hereinafter with reference to FIGS. 5 and 6.

As shown in FIG. 5, a winding device has a winding shaft 100 whose outer periphery is supported by a bearing base 104 via a bearing 102 so that the winding shaft 100 is rotatable axially. One end portion of the winding shaft 100 (i.e., a left-side end portion thereof in FIG. 5) is formed as a taper portion 106 in the shape of a truncated cone. An inner periphery of a collet sleeve 108 is fitted onto the taper portion 106 and a shaft hole 112 of the winding reel 110 can be fitted onto an outer periphery of the collet sleeve 108. The inner periphery of the collet sleeve 108 is formed in a tapered shape so as to correspond to the taper portion 106 of the winding shaft 100. The collet sleeve 108 is formed of an elastic body. When this collet sleeve 108 moves along the taper portion 106 in one direction along an axis of the winding shaft 10 from one end portion of the winding shaft 100 to the other end portion thereof (i.e., in the direction indicated by arrow A in FIG. 5), the diameter of the collet sleeve 108 increases (in the direction indicated by arrow C in FIG. 5). On the other hand, when the collet sleeve 108 moves along the taper portion 106 in the other direction along the axis of the winding shaft 10 (i.e., the direction indicated by arrow B in FIG. 6, which is opposite to that of arrow A in FIG. 5), the diameter of the collet sleeve 108 decreases (in the direction indicated by arrow D in FIG. 6, which is opposite to that of arrow C in FIG. 5).

A through hole 114 is formed in the winding shaft 100 along the axial direction thereof. A transmission rod 116 is disposed through the through hole 114 so as to be movable in the axial direction. One end portion of the transmission rod 116 on the side of one end portion of the winding shaft 100 is Joined to a base portion of the collet sleeve 108. Thus, when the transmission rod 116 moves, the collet sleeve 108 can also be moved in the same direction.

The through hole 114 is formed such that one side thereof on the side of the other end portion of the winding shaft 100 has a large diameter, so as to form a stepped portion 118. The other end portion of the transmission rod 116 forms a flange-shaped pressure-applied end portion 120 (pressed end). A coil spring 122 is fitted onto an outer periphery of the transmission rod 116 between the stepped portion 118 and the pressure-applied end portion 120. The coil spring 122 urges the transmission rod 116 in one direction along the axis of the winding shaft 100 from one end portion to the other end portion of the winding shaft 100 (i.e., the direction indicated by arrow A in FIG. 5).

An air cylinder 126 is mounted on and fixed to a device base 124 which the above-described bearing base 104 is mounted on and fixed to, and faces the pressure-applied end portion 120 of the transmission rod 116. The air cylinder 126 presses a pressing rod 128 moving with a piston against the pressure-applied end portion 120 of the transmission rod 116 and moves the transmission rod 116 in the other direction along the axis of the winding shaft 100 from the other end portion to one end portion of the winding shaft 100 (i.e., in the direction indicated by arrow B in FIG. 6) against urging force of the coil spring 122.

With this structure, in a state in which the winding reel 110 is mounted on the winding shaft 100 (i.e., in a clamp state), as shown in FIG. 5, the coil spring 122 urges the collet sleeve 108 in one direction along the axis of the winding shaft 100 (i.e., the direction of arrow A in FIG. 5). As a result, the collet sleeve 108 increases in diameter and holds, in a clamping manner, the winding reel 110 by force of the collet sleeve 108 derived from increasing in diameter. When the winding shaft 100 is driven to rotate by unillustrated means for rotating and driving force in the clamp state, the winding reel 110 rotates via the collet sleeve 108, so that filaments or the like can be wound around the winding reel 110.

In order to remove the winding reel 110 from the winding shaft 100, as shown in FIG. 6, it suffices that the air cylinder 126 is actuated such that the pressing rod 128 is driven in the other direction along the axis of the winding shaft 100 (i.e., in the direction of arrow B in FIG. 6). The pressing rod 128 presses against the pressure-applied end portion 120 of the transmission rod 116 against the urging force of the coil spring 122, so as to move the transmission rod 116 in one direction along the axis of the winding shaft 100. As a result, the collet sleeve 108 moves the taper portion 106 of the winding shaft 100 in the other direction along the axis of the winding shaft 100, so that the diameter of the collet sleeve 108 is reduced to a diameter of the shaft hole 112 of the winding reel 110 or less. Thus, the winding reel 110 is released from being clamped by the collet sleeve 108 so that the winding reel 110 can be removed from the winding shaft 100.

After the winding reel 110 has been removed from the winding shaft 100, when an empty winding reel 110 is fitted onto the collet sleeve 108 and subsequently the pressing rod 128 pressing against the pressure-applied end portion 120 of the transmission rod 116 is moved in one direction along the axis of the winding shaft 100, the pressing force of the pressing rod 128 is released so that the transmission rod 116 returns to its original position (i.e., the position shown in FIG. 5) by the urging force of the coil spring 122 and the collet sleeve 108 increases in diameter. The force of the collet sleeve 108 derived from increasing in diameter acts on the shaft hole 112 of the winding reel 110, which makes it possible to hold the winding reel 110 in a clamping manner.

In accordance with the above-described conventional winding device, when the diameter of the collet sleeve 108 is reduced to remove the winding reel 110 from the winding shaft 100, the pressing force exerted on the pressure-applied end portion 120 of the transmission rod 116 by the pressing rod 128 acts on the bearing 102 as thrust load. The thrust load is repeatedly applied to the bearing 102 perpendicularly to a direction in which the winding shaft 100 rotates, which causes deterioration of durability of the bearing 102.

In order to make it secure to mount the winding reel 110 on the winding shaft 100, the urging force of the coil spring 122 should be made larger to increase the force of the collet sleeve 108 derived from increasing in diameter. However, when the urging force of the coil spring 122 is made larger, large pressing force becomes required when the diameter of the collet sleeve 108 is reduced to remove the winding reel 110 from the winding shaft 100. This results in an increase in thrust load, and thus, the durability of the bearing deteriorates still further.

On the other hand, it is preferable from a viewpoint of higher productivity that a winding speed at which filaments or the like are wound around the winding reel 110 be increased still further. When the winding speed is high, a high-speed rotating bearing is used as the bearing 102. However, this high-speed rotating bearing usually lacks durability to thrust load.

Accordingly, in order to enlarge the urging force of the coil spring 122 to increase the force of the collet sleeve 108 derived from increasing in diameter and also in order to increase the winding speed by using a high-speed rotating bearing, there arises, particularly, need to frequently effect a maintenance operation such as replacement of a bearing.

SUMMARY OF THE INVENTION

In view of the aforementioned, it is one object of the present Invention to provide a winding device which prevents occurrence of thrust load in a bearing means when the diameter of a collet sleeve is reduced to remove a winding reel from a winding shaft.

Another object of the present invention is to provide a winding device which is suitable for use of a high-speed rotating bearing means.

In accordance with one aspect of the present invention, there is provided a winding device which a winding reel can be mounted on and removed from, comprising: a winding shaft having a through hole along an axial direction of the winding shaft and having a taper portion at one end portion thereof; bearing means for supporting said winding shaft such that said winding shaft is rotatable around its axis; a collet sleeve whose outer periphery can be fitted into the winding reel and whose inner periphery is fitted onto the taper portion of said winding shaft, said collet sleeve increasing in diameter when said collet sleeve moves along the taper portion in one direction along the axis of said winding shaft from one end portion to the other end portion of said winding shaft and said collet sleeve being capable of transmitting rotation of said winding shaft to the winding reel by its force derived from increasing in diameter, and further said collet sleeve decreasing in diameter when said collet sleeve moves along the taper portion in the other direction along the axis of said winding shaft from the other end portion to the one end portion of said winding shaft, so as to cause the winding reel to be removable from said collet sleeve; a transmission member passing through the through hole of said winding shaft so as to be movable in the axial direction of said winding shaft and being connected to said collet sleeve at one end portion of the transmission member disposed on the same side as the one end portion of said winding shaft, and when moving in the axial direction, said transmission member being capable of moving said collet sleeve in the same axial direction; clamping and urging means provided between said transmission member and said winding shaft, for urging said transmission member in the one direction along the axis of said winding shaft; a pressing member provided to face the other end portion of said transmission member, and when moving in the other direction along the axis of said winding shaft, said pressing member abutting and pressing against the other end portion of said transmission member from a separated position so that said transmission member moves in the other direction along the axis of said winding shaft against said clamping and urging means; driving means for driving said pressing member; and movement allowing means for allowing said driving means to move in the one direction along the axis of said winding shaft by reactive force received by said pressing member pressing against said transmission member; wherein said winding shaft has an engaging portion at the other end portion thereof and said driving means has a corresponding engaging portion which corresponds to the engaging portion, the corresponding engaging portion abutting against and engaging with the engaging portion of said winding shaft when said driving means moves in the one direction along the axis of said winding shaft, so as to prevent said driving means from moving in the one direction along the axis of said winding shaft still further.

With the winding device of the present invention, in a state in which the winding reel is mounted on the winding shaft, the transmission member is urged by urging force of the clamping and urging means in the other direction along the axis of the winding shaft (i.e., in a direction which is opposite to one direction along the axis of the winding shaft from one end portion to the other end portion thereof) and the collet sleeve is increased in diameter in the taper portion disposed at one end portion of the winding shaft. The force of the collet sleeve derived from increasing in diameter causes the winding reel to be clamped in the collet sleeve and the winding reel is adapted to be rotatable together with the winding shaft via the collet sleeve. When the winding shaft is driven to rotate, filaments or the like can be wound around the winding reel. At this time, the pressing member is separated from the other end portion of the transmission member and the corresponding engaging portion is separated from the engaging portion. As a result,, the pressing member and the corresponding engaging portion do not interfere with the rotating part of the device.

In order to remove the winding reel from the winding shaft, the driving means is actuated. When the driving means is actuated, the pressing member is driven to move in the other direction along the axis of the winding shaft and abuts against the other end portion of the transmission member and then presses the other end portion of the transmission member against the urging force of the clamping and urging means. The pressing member receives reactive force from the other end portion of the transmission member, which is caused by pressing of the pressing member. The driving means moves in one direction along the axis of the winding shaft by the reactive force. When the driving means moves in this direction, the corresponding engaging portion abuts against and engages with the engaging portion. The state in which the corresponding engaging portion and the engaging portion engage with each other prevents movement of the driving means in one direction along the axis of the winding shaft.

After the movement of the driving means has been prevented, the pressing for the other pressing member onto the other end portion of the transmission member acts on the corresponding engaging portion via the engaging portion and does not act on the bearing means as thrust load. As the pressing member continues to move in this state, the collet sleeve moves, following movement of the transmission member, along the taper portion of the winding shaft in the other direction along the axis thereof and the diameter of the collet sleeve is reduced. When the diameter of the collet sleeve is reduced, the winding reel is released from the clamp state and can be removed from the winding shaft.

In order to mount a new empty winding reel on the winding shaft, it suffices that, in the state in which the diameter of the collet sleeve is reduced, the winding reel is fitted onto the outer periphery of the collet sleeve and the other end portion of the transmission member is released from being pressing by the pressing member. The transmission member moves in one direction along the axis of the winding shaft by the urging force of the clamping and urging means, and at the same time, the collet sleeve moves along the taper portion of the winding shaft in the same direction and increases in diameter. The force of the collet sleeve derived from increasing in diameter causes the winding reel to return to the clamp state where the winding reel is rotatable together with the winding reel.

In this way, in the case in which the diameter of the collet sleeve is reduced to remove the winding reel from the winding shaft, it is possible to prevent occurrence of thrust load in the bearing means.

Accordingly, it is possible to prevent deterioration of the durability of the bearing means, which is caused by thrust load, thereby resulting in reduction in frequency of maintenance operation such as replacement of the bearing.

In order to make it secure to mount the winding reel on the winding shaft, the urging force of the clamping and urging means may be made larger so that the force of the collet sleeve derived from increasing in diameter increases. In this case, when the diameter of the collet sleeve is reduced to remove the winding reel from the winding shaft, the pressing force of the pressing member onto the other end portion of the transmission member is made larger. However, this does not damage the durability of the bearing means.

Further, even when a high-speed rotating bearing which lacks durability to thrust load is used as the bearing means in order to increase a winding speed at which filaments or the like are wound around the winding reel for improvement in productivity, there is no possibility that the durability of the bearing means be damaged.

In accordance with another aspect of the present invention, there is provided a winding device, in the above-described aspect of the present invention, which further comprises separating and urging means which can hold said pressing member in a state of being separated from the other end portion of said transmission member and which urges said driving means in the other direction along the axis of said winding shaft so as to separate the corresponding engaging portion from the engaging portion, said separating and urging means having urging force for moving said driving means in the one direction along the axis of said winding shaft against said separating and urging means by reactive force received by said pressing member pressing against said transmission member.

According to this aspect of the present invention, the separating and urging means is provided for urging the driving means in the other direction along the axis of the winding shaft. Therefore, in the clamp state, the state in which the pressing member is separated from the other end portion of the transmission member and the state in which the corresponding engaging portion is separated from the engaging portion are respectively held by the urging force of the separating and urging means. Further, when the winding reel returns to the clamp state after having been released from the clamp state, the pressing member and the corresponding engaging portion return to the state of being separated from the other end portion of the transmission member and the state of being separated from the engaging portion, respectively, by the urging force of the separating and urging means.

DESCRIPTION OF THE PREFERRED EMBODIMENT

Referring now to FIG. 1 through FIG. 4, a description will be given of an embodiment of a winding device according to the present invention.

Figure 1:
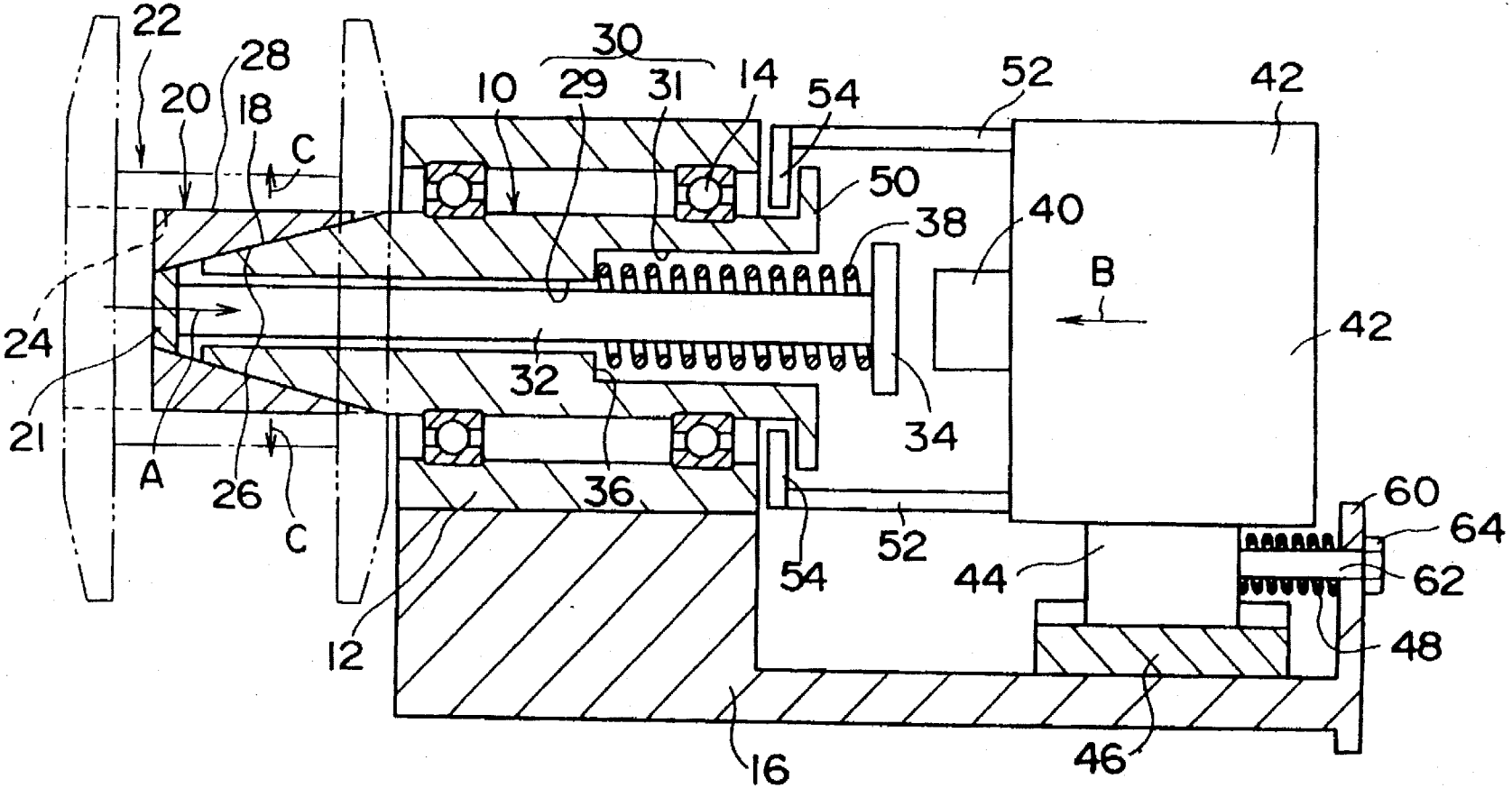
FIG. 1 is a longitudinally sectional view illustrating a winding device according to an embodiment of the present invention.
Figure 2:
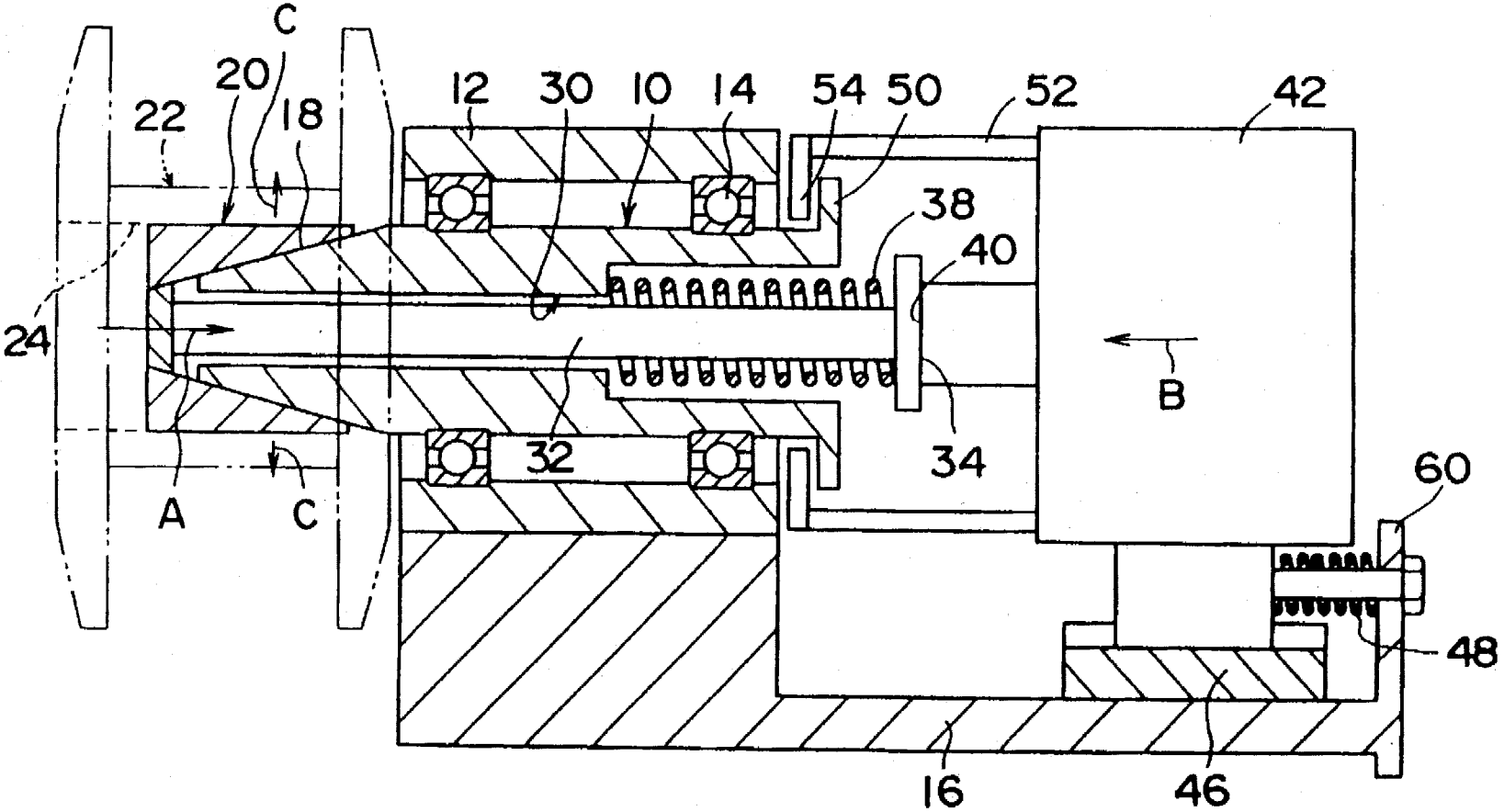
FIG. 2 is a diagram corresponding to FIG. 1 and illustrating an operational process when the diameter of a sleeve is reduced.
Figure 3:
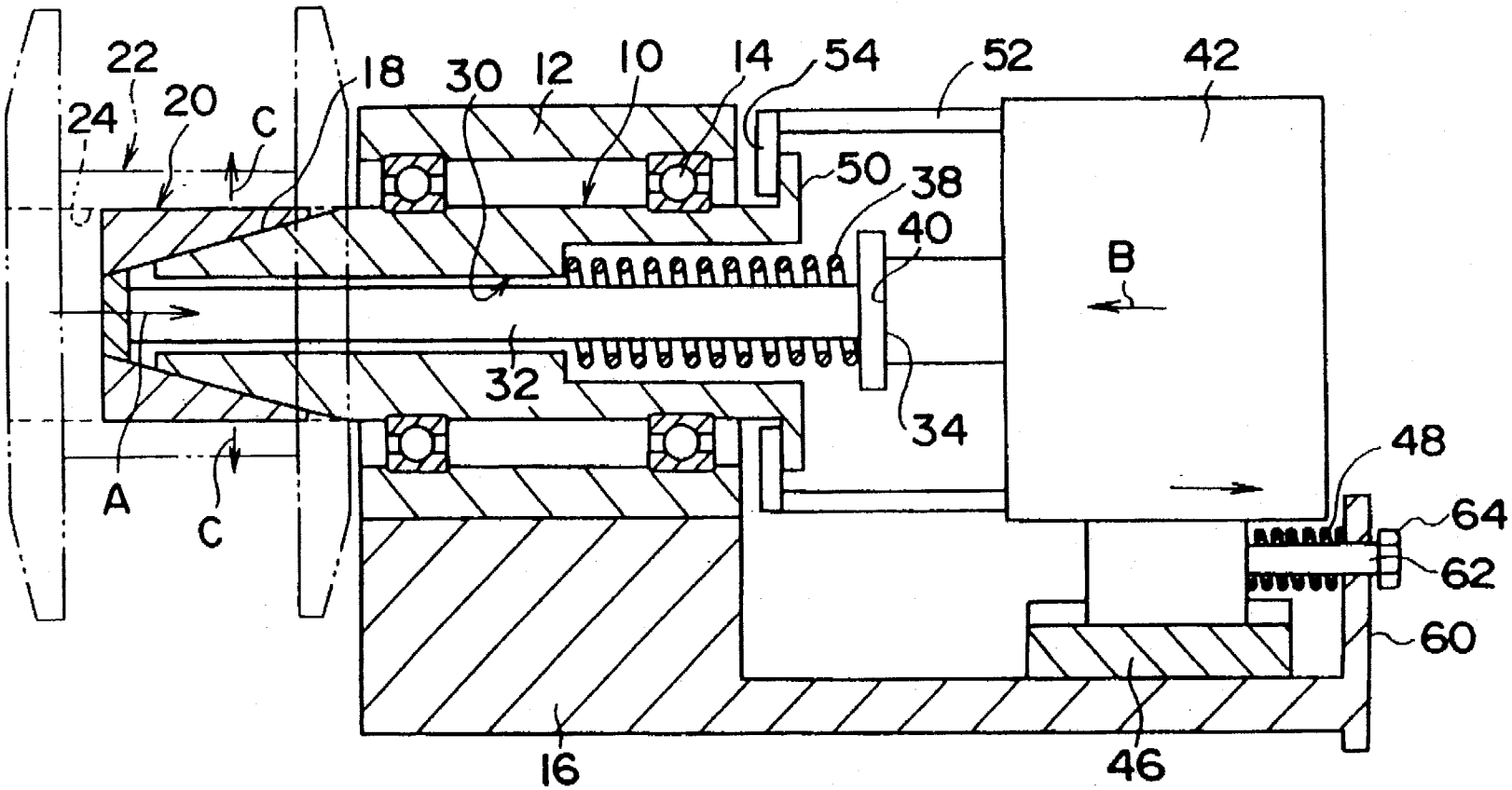
FIG. 3 is a diagram corresponding to FIG. 1 and illustrating a subsequent operational process.
Figure 4:
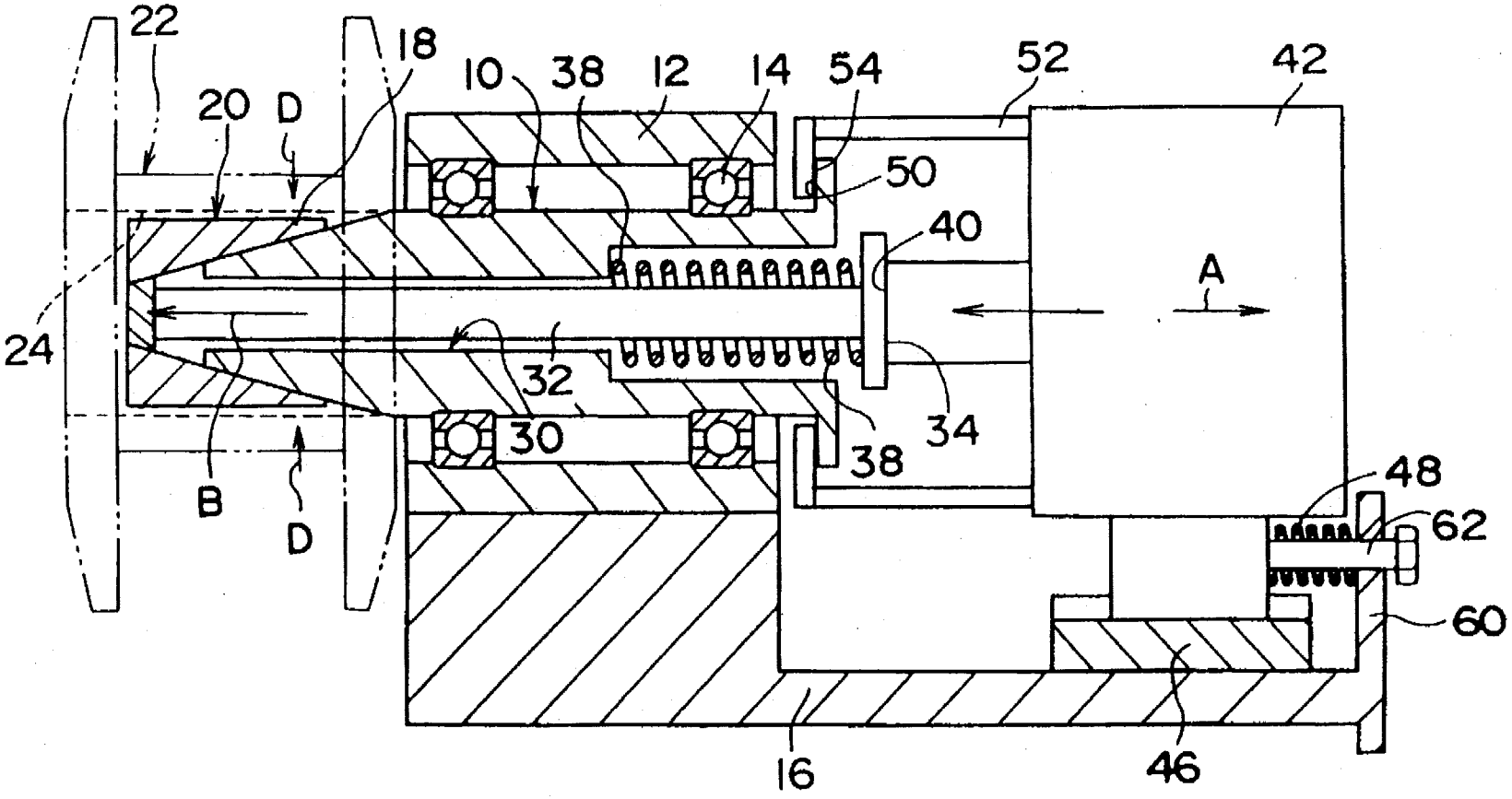
FIG. 4 is a diagram corresponding to FIG. 1 and illustrating a further subsequent operational process.
Figure 5:
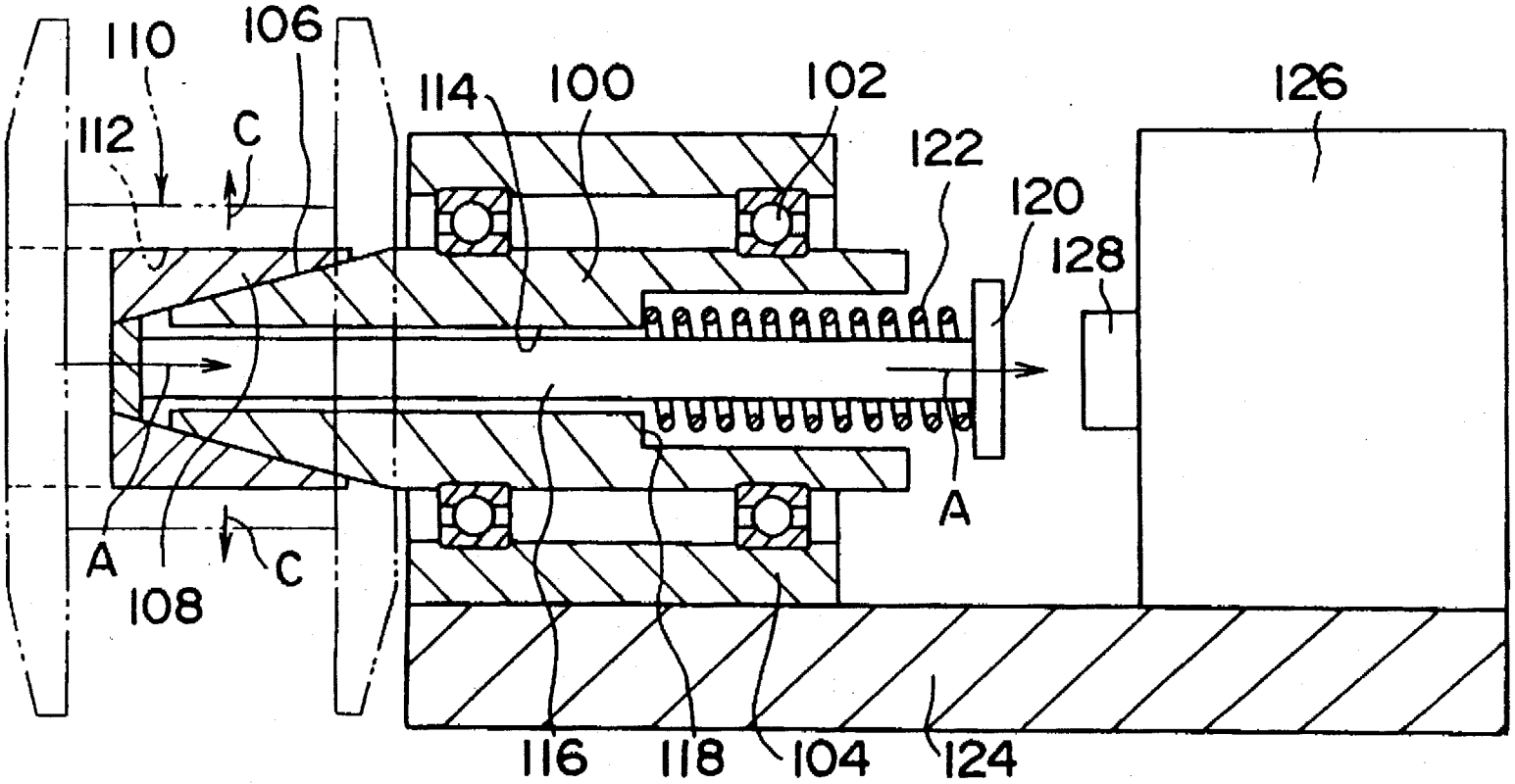
FIG. 5 PRIOR ART
FIG. 5 is a longitudinally sectional view illustrating a conventional winding device.
Figure 6:
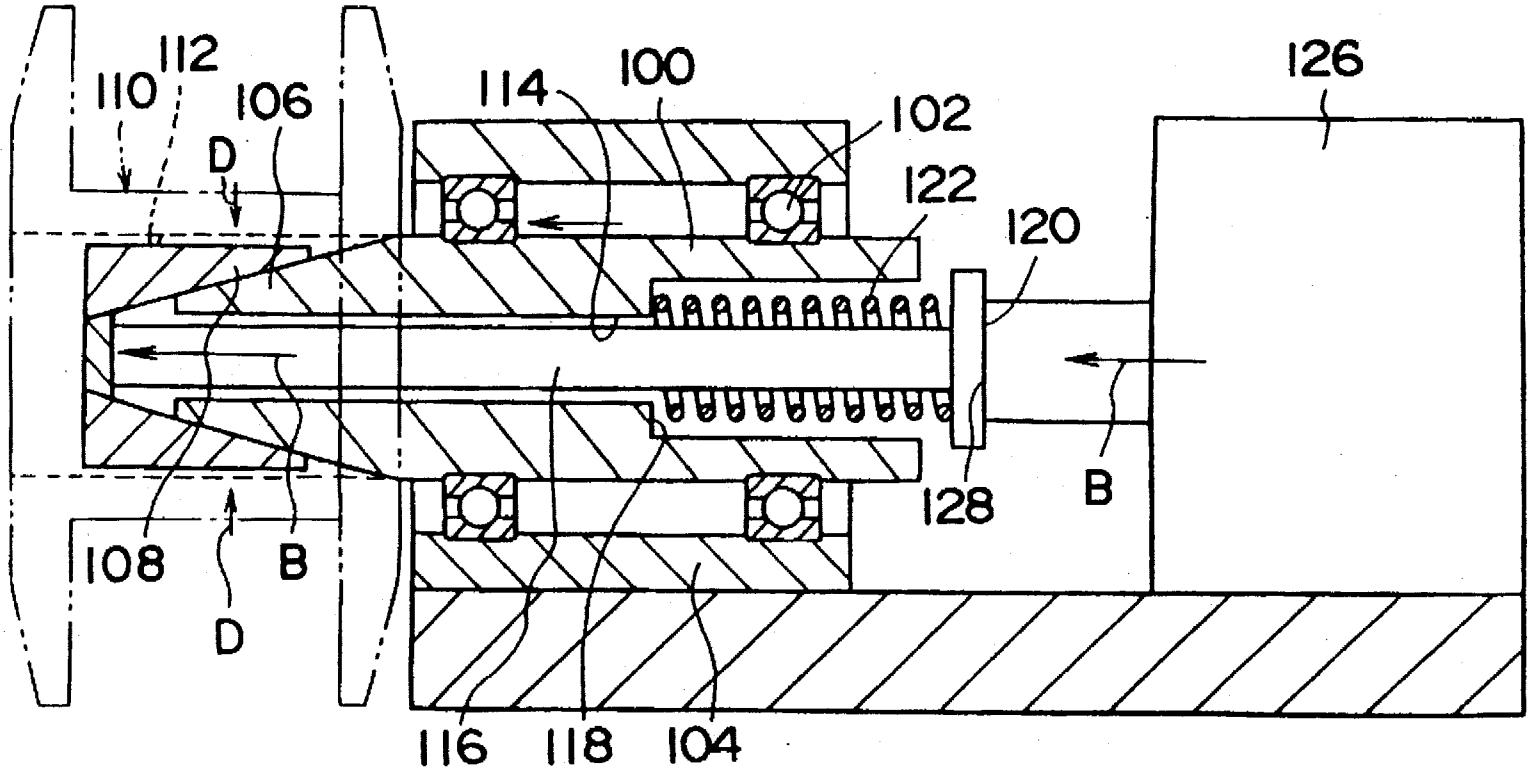
FIG. 6 PRIOR ART
FIG. 6 is a diagram corresponding to FIG. 5 and illustrating a state in which the diameter of a sleeve is reduced.

In a winding device shown in FIG. 1, a winding shaft 10 disposed horizontally is supported so as to be axially rotatable by a cylindrical bearing base 12 disposed coaxially around the winding shaft 10 via a bearing 14 serving as bearing means. The bearing base 12 is mounted on and fixed to one end portion of a device base 16 (i.e., a left-side end portion thereof in FIG. 1) which is horizontally disposed along an axial direction of the winding shaft 10. One end portion of the winding shaft 10 (the left-side end portion thereof in FIG. 1) projects from the bearing base 12 to form a taper portion 18 in the shape of a truncated cone. An inner periphery of a collet sleeve 20 is fitted onto the taper portion 18. The collet sleeve 20 is formed in a cylindrical shape with one end portion thereof (i.e., a left-side end portion in FIG. 1) closed by a base portion 21. The inner peripheral surface of the collet sleeve 20 is formed as a corresponding taper portion 26 in the shape of a truncated cone in correspondence with the configuration of the taper portion 18 of the winding shaft 10. An outer peripheral surface of the collet sleeve 20 is formed straight, i.e., in a state of not being inclined with respect to the axial direction so as to form a fitting portion (i.e., pressing portion) 28 which can fit into a shaft hole 24 of a winding reel 22.

The collet sleeve 20 is formed of an elastic body and the diameter thereof is adapted to be expandable and contractible. For this reason, as the collet sleeve 20 moves along the taper portion 18 of the winding shaft 10 in one direction along the axis of the winding shaft 10 from one end portion of the winding shaft 10 to the other end portion thereof (i.e., in the direction indicated by arrow A), the collet sleeve 20 increases in diameter in the direction indicated by arrow C (see FIG. 1 through FIG. 3). On the other hand, as the collet sleeve 20 moves in the other direction along the axis of the winding shaft 10 from the other end portion of the winding shaft 10 to one end portion thereof (i.e., in the direction indicated by arrow B), the diameter of the collet sleeve 20 is reduced in the direction indicated by arrow D in FIG. 4. As a result, with the diameter of the collet sleeve 20 increased, the collet sleeve 20 is kept, in a clamping manner, within the shaft hole 24 of the winding reel 22 to elastically hold the reel 22 by force of the collet sleeve 20 derived from increasing in diameter. Thus, the winding reel 22 can be rotated together with the winding shaft 10. Meanwhile, with the diameter of the collet sleeve 20 reduced, the diameter thereof becomes smaller than a hole diameter of the shaft hole 24 of the winding reel 22 and the collet sleeve 20 is released from holding the winding reel 22 so that the winding reel 22 can be removed from the winding shaft 10 in the axial direction (i.e., the direction indicated by arrow B in FIG. 4). It should be noted that, in a clamp state, when the winding shaft 10 is driven to rotate, filaments or the like can be wound around the winding reel 22.

A through hole 30 is formed in the winding shaft 10 to be disposed along the axial direction and coaxially with the winding shaft 10. A transmission rod 32 serving as a transmission member is provided within the through hole 30 in such a manner as to pass therethrough movably along the axial direction of the windlng shaft 10. One end portion of the transmission rod 32 (i.e., a left-side end portion thereof in FIG. 1) projects from the through hole 30 and is joined to the base portion 21 of the collet sleeve 20. As a result, as the transmission rod 32 is moved in the axial direction of the winding shaft 10, the collet sleeve 20 can also be moved in the same direction. The other end portion of the transmission rod 32 projects out of the through hole 30 to form a pressure-applied end portion 34 in the shape of a large-diameter plate. The through hole 30 has a small-diameter portion 29 and a large-diameter portion 31 disposed on the sides of one end portion and the other end portion of the winding shaft 10, respectively. A stepped portion 36 is provided between the small-diameter portion 29 and the large-diameter portion 31. A coil spring 88 serving as clamping and urging means is fitted onto a circumferential portion of the transmission rod 32, between the stepped portion 36 within the through hole 30 and the pressure-applied end portion 84 of the transmission rod 82. The coil spring 38 urges the transmission rod 32 in one direction along the axis of the winding shaft 10 (i.e., in the direction indicated by arrow A). The small-diameter portion 29 serves as a guide for moving and guiding the transmission rod 32 in the axial direction of the winding shaft 10. The large-diameter portion 31 serves as an installation space for the coil spring 38.

A piston rod 40 serving as a pressing member is provided coaxially with the winding shaft 10 in such a manner as to face the pressure-applied end portion 34 of the transmission rod 32. The piston rod 40 is adapted to be movable in the axial direction of the winding shaft 10 and is driven by an air cylinder 42 mounted on the device base 16 and serving as a driving portion. An air-cylinder supporting table 44 disposed on a lower surface of the air cylinder 42. is supported by a linear guide 46 disposed on an upper surface of the device base 16 and serving as movement allowing means, so that the air cylinder 42 becomes movable on the linear guide 46 along the axial direction of the winding shaft 10. A coil spring 48 serving as separating and urging means is provided between the air cylinder 42 and the device base 16. The coil spring 48 urges the air cylinder 42 In the other direction along the axis of the winding shaft 10 (i.e., in the direction indicated by arrow B).

The other end portion of the winding shaft 10 projects out of the bearing base 12 to form a flange 50 extending outward in a radial direction of the winding shaft 10 and serving as an engaging portion. The air cylinder 42 is provided with an arm 52 which extends toward the other end portion of the bearing base 12 and across an outer periphery of the flange 50 of the winding shaft 10. An extended leading end of the arm 52 is formed as a pawl piece 54 serving as a corresponding engaging portion. The pawl piece 54 projects inward in the radial direction in such a manner as to enter between the other end portion of the bearing base 12 and the flange 50 of the winding shaft 10.

In a state in which the piston rod 40 is withdrawn, a leading end surface of the piston rod 40 is separated from the pressure-applied end portion 34 of the transmission rod 32 and the pawl piece 54 is separated from both the other end portion of the bearing base 12 and the flange 50 of the windlng shaft 10. The respective separated states are held by urging force of the coil spring 48.

Meanwhile, the coil spring 48 is provided between an air-cylinder supporting table 44 and a vertical piece 60 formed uprightly from the device base 16. Further, the coil spring 48 is provided to be fitted onto a circumferential portion of a bolt 62 screwed in the air-cylinder supporting table 44 and passing through the vertical piece 60 in such a manner that the bolt 62 is movable in the axial direction of the winding shaft 10. By changing a length by which the bolt 62 is screwed in the air-cylinder supporting table 44, it is possible to adjust an interval between the leading end surface of the piston rod 40 and the pressure-applied end portion 34 of the transmission rod 32, and an interval between the pawl piece 54 and the flange 50 of the winding shaft 10. Namely, movement of the air cylinder 42 in the other direction along the axis of the winding shaft 10 is restricted by a head portion 64 of the bolt 62 abutting against the vertical piece 60.

It should be noted that the urging force of the coil spring 48 is less than that of the coil spring 38 for purposes as described below. When the piston rod 40 is pushed out in the other direction along the axis of the winding shaft 10 (i.e., in the direction indicated by arrow B) so that the leading end surface of the piston rod 40 abuts against and presses the pressure-applied end portion 34 of the transmission rod 32 and receives reactive force, the air cylinder 42 moves in one direction along the axis of the winding shaft 10 (i.e., in the direction indicated by arrow A) against the urging force of the coil spring 48. This movement of the air cylinder 42 causes the pawl piece 54 to abut against and engage with the flange 50. When the pawl piece 54 and the flange 50 engage with each other, the air cylinder 42 is prevented from moving in the other direction along the axis of the winding shaft 10 still further.

Meanwhile, the following specifications of the winding shaft 10 are applicable. The winding shaft 10 is made of steel and has an outer diameter of 50 mm. The taper portion 18 has an cone angle of 5° and its outer diameter is reduced to 28 mm. The flange 50 has an outer diameter of 90 mm. The small-diameter portion 29 of the through hole 30 has a cylindrical shape with a hole diameter of 18 mm and a longitudinal dimension of 152 mm, and the large-diameter portion 31 of the through hole 30 has a cylindrical shape with a hole diameter of 34 mm.

Further, as the collet sleeve 20, a structure is applicable which is made of metallic material and has a cone angle of 5° in a manner similar to the taper portion 18 of the winding shaft 10. As the transmission rod 32, a columnar structure is applicable which has a diameter of 16 mm and a longitudinal dimension of 400 mm. As the coil spring 38, a structure is applicable which has a spring constant of 1.5 kg/mm and a compressive force of 70 kg or more in the clamp state.

Further, there can be used a structure in that, in the clamp state (i.e., in a state in which the piston rod 40 is withdrawn), the interval, in the axial direction of the winding shaft 10, between the pawl piece 54 of the arm 52 of the air cylinder 42 and the flange 50 of the winding shaft 10 is set to 25 mm and the interval between the leading end surface of the piston rod 40 and the pressure-applied end portion 34 of the transmission rod 32 is set to 5 mm.

Next, operation of the above-described embodiment will be described.

In a state in which the winding reel 22 is mounted on the winding shaft 10 (i.e., in the clamp state) which is shown in FIG. 1, the transmission rod 32 is urged in one direction along the axis of the winding shaft 10 (i.e., the direction indicated by arrow A), so that the diameter of the collet sleeve 20 is enlarged in the taper portion 18 disposed at one end portion of the winding shaft 10. The force of the collet sleeve 20 derived from increasing in diameter enables the winding reel 22 to rotate together with the winding shaft 10 via the collet sleeve 20. When the winding shaft 10 is driven to rotate, filaments or the like can be wound around the winding reel 22. At this time, the leading end surface of the piston rod 40 is separated from the pressure-applied end portion 34 of the transmission rod 32 and the pawl piece 54 of the arm 52 of the air cylinder 42 is separated from the flange 50 of the winding shaft 10. For this reason, the piston rod 40 and the pawl piece 54 interfere with the rotating part of the device.

In order to remove the windlng reel 22 from the winding shaft 10, i.e., to release the winding reel 22 from the clamp state, the air cylinder 42 is actuated. When the air cylinder 42 is actuated, the piston rod 40 is driven to move (advance) in the other direction along the axis of the winding shaft 10 (i.e., in the direction of arrow B) and the leading end surface of the piston rod 40 abuts and presses against the pressure-applied end portion 34 of the transmission rod 32 in the other direction along the axis of the winding shaft 10, i.e., in the direction of arrow B (the state shown in FIG. 2). When the leading end surface of the piston rod 40 presses against the pressure-applied end portion 34 of the transmission rod 32 against the urging force of the coil spring 38, the piston rod 40 receives reactive force from the pressure-applied end portion 34. When the reactive force is applied to the piston rod 40, the air cylinder 42 moves (back) on the linear guide 46 in one direction along the axis of the winding shaft 10 (i.e., the direction of arrow A). When the air cylinder 42 moves in one axial direction of the winding shaft 10, the pawl piece 54 abuts against and engages with the flange 50 (see FIG. 3). When the pawl piece 54 and the flange 50 engage with each other, the air cylinder 42 is prevented from moving in one direction along the axis of the winding shaft 10 (i.e., in the direction of arrow A).

After the air cylinder 42 has been prevented from moving in the direction of arrow A, pressing force of the leading end surface of the piston rod 40 onto the pressure-applied end portion 34 of the transmission rod 32 acts on the pawl piece 54 via the flange 50 (i.e., pressing force is supported by or applied to the pawl piece 54) and does not act on the bearing 14 as thrust load. When the piston rod 40 moves, the collet sleeve 20 moves (advances), following movement of the transmission rod 32, along the taper portion 18 of the winding shaft 10 in the other direction along the axis of the winding shaft 10 (i.e., in the direction of arrow B) and the diameter of the collet sleeve 20 is reduced (the state shown in FIG. 4). With the diameter of the collet sleeve 20 reduced, the clamp state is released and the winding reel 22 can be removed from the winding shaft 10.

In order to mount a new empty winding reel 22 on the winding shaft 10, it suffices that the winding reel 22 be fitted onto an outer periphery of the collet sleeve 20 whose diameter is reduced and the pressure-applied end portion 34 of the transmission rod 32 be released from being pressed by the leading end surface of the piston rod 40. The transmission rod 32 moves in one direction along the axis of the winding shaft 10 (1.e., the direction of arrow A) by urging force of the coil spring 38, and at the same time, the collet sleeve 20 moves along the taper portion 18 of the winding shaft 10 in the same direction and increases in diameter. Thus, the force of the collet sleeve 20 derived from increasing in diameter causes the winding reel 22 to return to the clamp state where the winding reel 22 can rotate together with the winding shaft 10.

When the diameter of the collet sleeve 20 is reduced to remove the winding reel 22 from the winding shaft in the above-described manner, it is possible to prevent generation of thrust load on the bearing 14.

Accordingly, it is possible to prevent deterioration of durability of the bearing 14, which is caused by thrust load, thereby resulting in reduction in frequency of maintenance operation such as replacement of the bearing 14. In a conventional device, for example, replacement of the bearing is required after an exchanging operation of winding reels 22 is repeated hundreds of times. However, the present embodiment eliminates need for replacement of the bearing.

If the urging force of the coil spring 38 is increased so that the force of the collet sleeve 20 derived from increasing in diameter increases to make it secure to mount the winding reel 22 on the winding shaft 10, when the diameter of the collet sleeve 20 is reduced for removing the winding reel 22 from the winding shaft 10, the pressing force of the leading end surface of the piston rod 40 onto the pressure-applied end portion 34 of the transmission rod 32 increases. However, the durability of the bearing 14 does not deteriorate.

Further, even when a high-speed rotating bearing which lacks durability to thrust load is used as the bearing means in order to increase a winding speed at which filaments or the like are wound around the winding reel 22 for improvement in productivity, there is no possibility that durability of the bearing means deteriorates due to thrust load.

Meanwhile, since the coil spring 48 is provided for urging the air cylinder 42 in the other direction along the axis of the winding shaft 10 (i.e., the direction of arrow B), in the clamp state, the state in which the leading end surface of the piston rod 40 is separated from the pressure-applied end portion 34 of the transmission rod 32 and the state in which the pawl piece 54 is separated from the flange 50 are respectively maintained by the urging force of the coil spring 48. Further, when the winding reel 22 returns to the clamp state after having been released from the clamp state, the state in which the leading end surface of the piston rod 40 is separated from the pressure-applied end portion 34 of the transmission rod 32 and the state in which the pawl 54 is separated from the flange 50 are respectively obtained again by the urging force of the coil spring 48.

While and after the air cylinder 42 is moving back in the direction of arrow A until the pawl piece 54 abuts against the flange 50 by the leading end surface of the piston rod 40 pressing against the pressure-applied end portion 34 of the transmission rod 2, load which corresponds to the urging force of the coil spring 38 acts on the bearing 14 as thrust load. However, the urging force of the coil spring 48 can be selected to be smaller in comparison with the urging force of the coil spring 38. Namely, as described above, the urging force of the coil spring 48 is sufficient to attain the degree that the state where the leading end surface of the piston rod 40 be separated from the pressure-applied end portion 34 of the transmission rod 32 and the state where the pawl piece 54 be separated from the flange 50 can respectively be maintained in the clamp state, and also the degree that the state where the leading end surface of the piston rod 40 be separated from the pressure-applied end portion 34 of the transmission rod 32 and the state where the pawl piece 54 be separated from the flange 50 can respectively be obtained again when the winding reel 22 returns to the clamp state after having been released from the clamp state. As a result, in comparison with the conventional device, thrust load acting on the bearing 14 is reduced.

Instead of the above-described separating and urging means, other means may also be used to hold, in the clamp state, the state where the leading end surface of the piston rod 40 is separated from the pressure-applied end portion 34 of the transmission rod 32 and the state where the pawl 54 is separated from the flange 50 and further to hold, when the winding reel 22 returns to the clamp state after having been released from the clamp state, the state where the leading end surface of the piston rod 40 is separated from the pressure-applied end portion 34 of the transmission rod 32 and the state where the pawl piece 54 is separated from the flange 50.

The present invention is not limited to the above-described embodiment and various modifications are applicable. For example, the driving portion is not limited to the air cylinder 42, the pressing member is not limited to the piston rod 40, the bearing means is not limited to the bearing 14, and the clamping and urging means and the separating and urging means are not limited to the coil springs 38, 48, respectively. Further, the collet sleeve is not limited to the structure shown in the above-described embodiment. Moreover, in place of the pawl piece 54 and the flange 50, an engaging portion and a corresponding engaging portion which can engage with each other, may also be used.

Further, in the above-described embodiment, a description was given of the winding device in which the winding shaft 10 and the device base 16 are respectively disposed horizontally. However, each of directions in which the winding shaft 10 and the device base 16 are arranged is not limited to the horizontal direction. For example, the axial direction of the winding shaft 10 may be disposed in a vertical direction, not in a horizontal direction, or may be disposed in a state of being inclined to any arbitrary direction.

What is claimed is:

1. A winding device which a winding reel can be mounted on and removed from, comprising:

a rotatable winding shaft having a through-hole along an axial direction of the winding shaft and having a tapered end, said through-hole having a first diameter at the tapered end and a second diameter at the other end, said second diameter being larger than said first diameter wherein a stepped-diameter portion is formed in said through-hole;

bearing means for supporting said winding shaft such that said winding shaft is rotatable around its axis, said bearing means being adapted to be fitted into a device base;

a collet sleeve adapted to receive the winding reel, said collet sleeve having an outer periphery adapted to be detachably fitted into the winding reel and having an inner periphery slidably fitted onto the tapered end of said winding shaft, said collet sleeve increasing in diameter when sliding along the tapered end toward the taper to engage the winding reel, wherein the rotation of said winding shaft is transmitted to the winding reel, said collet sleeve decreasing in diameter when sliding along the tapered end away from the taper to release the winding reel from said collet sleeve;

a transmission member having two ends, one end equipped with a flange having a diameter larger than the second diameter of said through-hole, the other end being fixed to said collet sleeve, said transmission member passing through the through-hole of said winding shaft and being movable in the axial direction of said winding shaft, wherein the flange-equipped end protrudes from said winding shaft;

clamping and urging means provided between said flange-equipped end of said transmission member and said stepped-diameter portion of said winding shaft, for urging said transmission member in a direction to move said collet sleeve along the tapered end of said winding shaft toward the taper to engage the winding reel;

a pressing member provided to face the flange of said transmission member, for abutting and pressing said transmission member against said clamping and urging means to move said collet sleeve along the tapered end of said winding shaft away from the taper to release the winding reel from said collet sleeve;

driving means for driving said pressing member;

movement-allowing means provided on the device base, for allowing said driving means to move away from said winding shaft by reactive force received by said pressing member upon pressing said flange of said transmission member; and movement-preventing means provided with said driving means for preventing said driving means from moving away from said winding shaft by engaging with said winding shaft at an engaging portion of said winding shaft after said driving means is allowed to move away from said transmission member by said movement-allowing means.

2. A winding device according to claim 1, wherein said collet sleeve is made of an elastic material.

3. A winding device according to claim 1, wherein said clamping and urging means is a coil spring.

4. A winding device according to claim 1, wherein said engaging portion of said winding shaft and said movement-preventing means are engaged via surface contact.

5. A winding device according to claim 1, wherein said engaging portion of said winding shaft has a structure to be fitted into and engaged with said movement-preventing means.

6. A winding device according to claim 1, wherein said engaging portion of said winding shaft is formed in a flange.

7. A winding device according to claim 1, wherein the axis of said winding shaft is in a vertical, horizontal, or slanted direction.

8. A winding device according to claim 1, further comprising a second urging means for urging said driving means toward said winding shaft to detach said movement-preventing means from said engaging portion of said winding shaft when said pressing member is detached from the flange of said transmission member, wherein the urging force of said second urging member is weaker than that of said clamping and urging means to engage said movement-preventing means and said engaging portion of said winding shaft while said pressing member presses the flange of said transmission member, said second urging means being provided between said driving means and the device base.

9. A winding device according to claim 8, wherein said movement-allowing means comprises a bolt having two ends, one being screwed into said driving means, the other passing through a hole formed in the device base, wherein said bolt is freely movable through the hole, wherein said second urging means is provided along said bolt.

10. A winding device according to claim 8, wherein said second urging means is a coil spring.

* * * * *